US006763825B1

(12) United States Patent
Geible

(10) Patent No.: US 6,763,825 B1
(45) Date of Patent: Jul. 20, 2004

(54) STOVE TOP COVER

(75) Inventor: Norman P. Geible, Kernersville, NC (US)

(73) Assignee: Camco Manufacturing, Inc., Greensboro, NC (US)

( * ) Notice: Subject to any disclaimer, the term of this patent is extended or adjusted under 35 U.S.C. 154(b) by 59 days.

(21) Appl. No.: 10/097,282

(22) Filed: Mar. 14, 2002

(51) Int. Cl.[7] ..... F24C 15/10

(52) U.S. Cl. ..... 126/214 R; 126/221; 108/156; 248/188.9

(58) Field of Search ..... 126/214 R, 211, 126/216, 214 C, 214 D, 221, 215, 212, 304 R, 304 A, 305; 108/50.11, 156, 158, 157.1, 157.16, 158.12; 248/188.9, 346.11

(56) References Cited

U.S. PATENT DOCUMENTS

| | | | | | |
|---|---|---|---|---|---|
| 727,251 | A | * | 5/1903 | Allen | 126/211 |
| 1,985,980 | A | * | 1/1935 | Dibble | 126/214 R |
| 2,503,132 | A | * | 4/1950 | Robinson et al. | 126/214 B |
| 2,696,812 | A | | 12/1954 | Merritt, Jr. | |
| 3,288,405 | A | * | 11/1966 | Johnson | 248/188.9 |
| 4,361,132 | A | | 11/1982 | Adkins | |
| 4,979,786 | A | * | 12/1990 | Kuraseko | 248/188.9 |
| 5,115,797 | A | | 5/1992 | Hurner | |
| 5,331,945 | A | * | 7/1994 | Somerton | 126/214 R |
| 5,353,781 | A | * | 10/1994 | Calvillo | 126/221 |
| 5,406,656 | A | | 4/1995 | Somerton | |
| 6,044,834 | A | * | 4/2000 | Zappetti | 126/214 D |

FOREIGN PATENT DOCUMENTS

| | | | | |
|---|---|---|---|---|
| GB | 2 204 676 A | * | 11/1988 | F24C/15/10 |
| JP | 8-61680 A | * | 3/1996 | F24C/15/36 |

OTHER PUBLICATIONS

CAMCO Oak Accents "Silent Top" brochure (undated).
Whats Manufacturing "Quite Top" brochure (undated).

* cited by examiner

*Primary Examiner*—Josiah Cocks

(57) ABSTRACT

A stove cover is provided having a plurality of resilient feet. The resilient feet each contain a channel for engaging the grate atop the stove to hold it firmly in place and to prevent rattling. The cover includes a series of apertures for selective attaching the the feet at different locations thereon, depending on the particular stove and grate used with the cover.

12 Claims, 3 Drawing Sheets

STOVE TOP COVER

FIELD OF THE INVENTION

The invention herein pertains to recreational vehicles (RVs) stove top covers and particularly pertains to stove top covers used with stoves having a grate.

DESCRIPTION OF THE PRIOR ART AND OBJECTIVES OF THE INVENTION

It is usual in the RV, mobile homes, motor home and other industries to provide stove top covers formed of wood and other materials to provide extra counter top space in confined kitchen areas. In recent years certain stove manufacturers have furnished stoves with "grates" and while conventional stove top covers work, they can become loose and slide on the grates under normal conditions. If the RV is driven over rough roads the stove top cover can be very noisy and can even fall from the stove. Thus, with the disadvantages and problems associated with prior stove top covers, the present invention was conceived and one of its objectives is to provide a stove top cover which is attractive and which will securely remain in place while traveling over uneven roads and the like.

It is still another objective of the present invention to provide a stove top cover which can be selectively fitted with feet to fit various size and shaped stove grates.

It is still another objective of the present invention to provide a stove top cover which has feet which include a channel or groove to securely engage the grate.

It is still another objective of the present invention to provide a stove top cover in which a plurality of apertures are available to the user so the feet can be positioned at selected, different locations for various grate configurations.

It is a further objective of the present invention to provide a stove top cover with a resilient mat affixed for use without the feet under special conditions.

Various other objectives and advantages of the present invention will become apparent to those skilled in the art as a more detailed description is set forth below.

SUMMARY OF THE INVENTION

The aforesaid and other objectives are realized by providing a stove top cover having a rigid panel with the underneath or bottom surface having a series of pre-drilled apertures for selective placement of feet therealong. Also affixed to the bottom surface is a resilient mat which can be used in certain instances to help secure the stove top cover when the feet are not attached. A threaded fastener is used to attach each foot to the panel through a central opening therein. The feet are made of a resilient rubber and include a channel for straddling the grate members. By straddling the grate the top remains in a secure position even under adverse road conditions such as on rough or unpaved roads while preventing rattling of the stove grate and rattling and dislodgement of the stove top cover.

DETAILED DESCRIPTION OF THE PREFERRED EMBODIMENT AND OPERATION OF THE INVENTION

Figure 2:
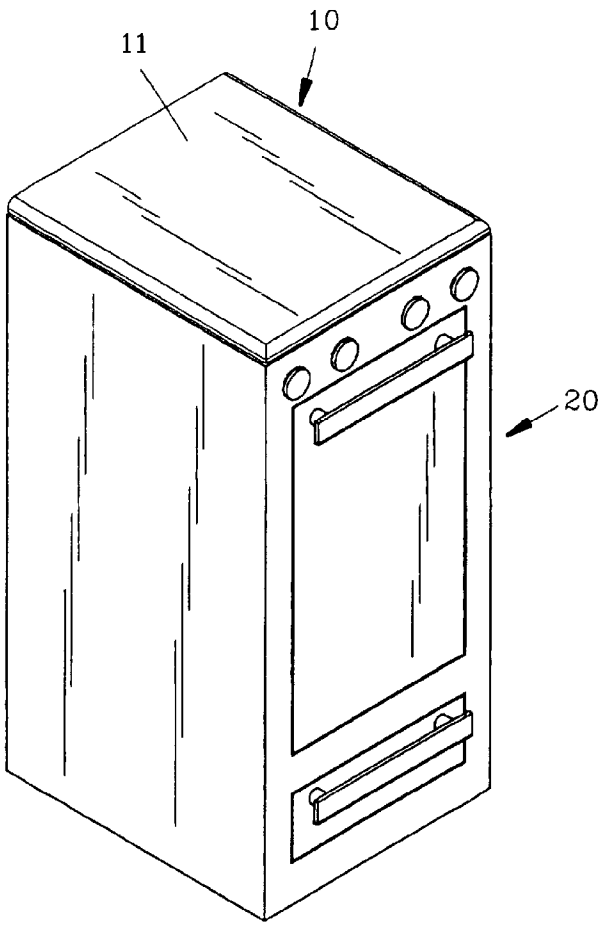
FIG. 2 illustrates the stove as shown in FIG. 1 but with the cover securely in place.
Figure 1:
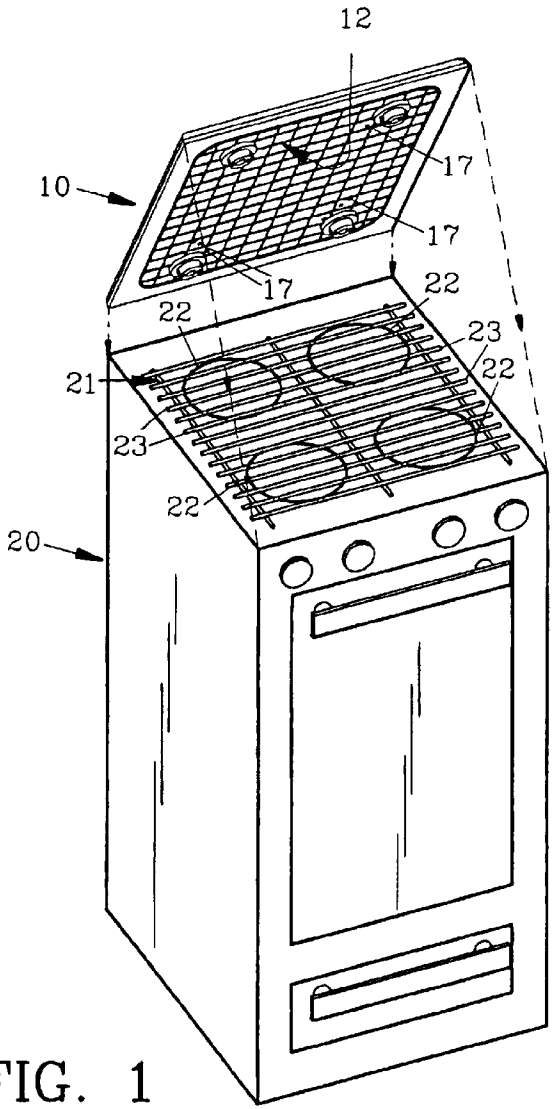
FIG. 1 demonstrates a typical stove with a grate as used in an RV with the top cover exploded therefrom.
Figure 4:
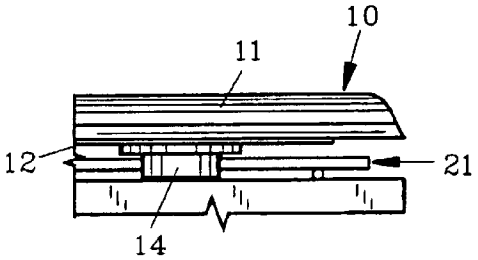
FIG. 4 illustrates an enlarged sectional view of the cover and stove to illustrate the grate engaged by the foot as seen along lines 4—4 of FIG. 3.
Figure 3:
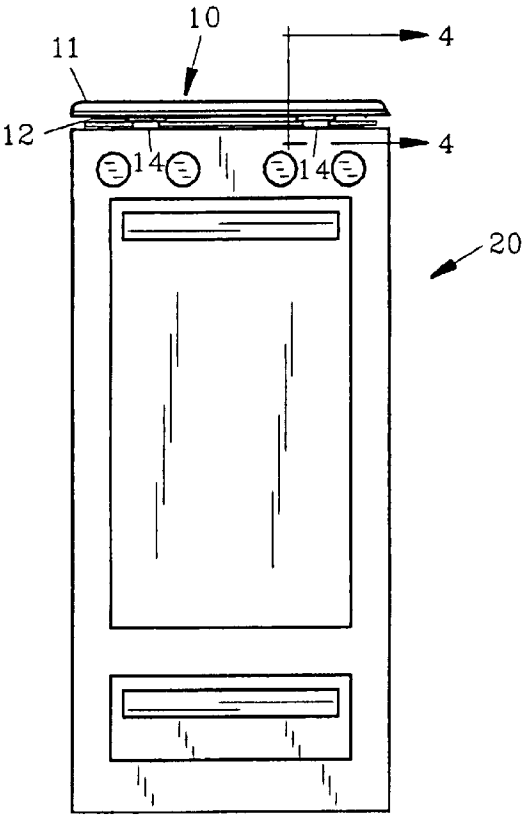
FIG. 3 depicts a front elevational view of the stove and cover as shown in FIG. 2.
Figure 6:
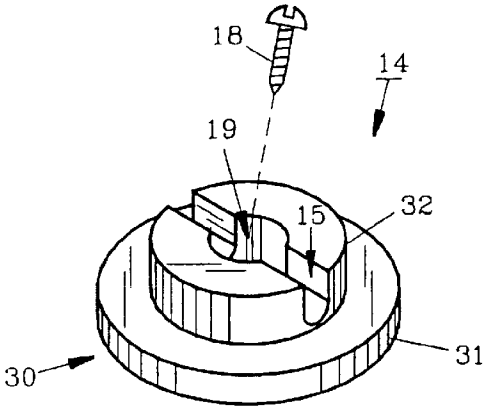
FIG. 6 pictures an inverted view of the foot as seen in FIG. 5.
Figure 8:
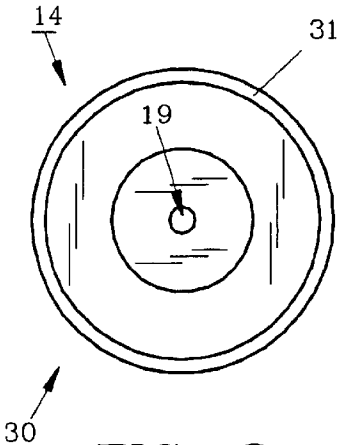
FIG. 8 depicts a top plan view thereof.

For a better understanding of the invention and its operation, turning now to the drawings, FIG. 1 demonstrates preferred stove top cover 10 exploded from conventional stove 20 having grate 21 positioned over four (4) burners 22, although stoves with two (2) or three (3) burners may be used. Burners 22 may be electrical or gas operated as are conventional in the RV industry. To provide additional counter space in the confined quarters of an RV or in a similar environment such as in a mobile home, cover 10 provides such when stove 20 is not in use as seen in FIG. 2. Preferred cover 10 includes a planar finished wooden panel 11 which has affixed on its underneath or bottom surface standard resilient mat 12 as shown in FIGS. 3 and 4 with apertures 17 (FIG. 1). While preferred cover 10 utilizes wooden panel 11, other types of materials may also be employed such as plastics or metals. Mat 12 adds stability and prevents panel 11 from slipping when on stove 20 while reducing noise between panel 11 and stove 20, particularly if used without feet 14.

Figure 9:
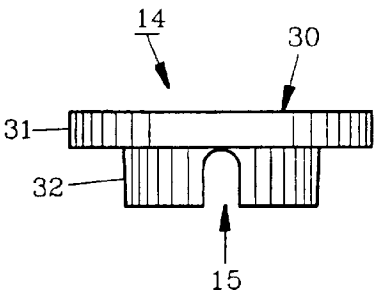
FIG. 9 shows a side elevational view of the foot as shown in FIG. 7.
Figure 5:
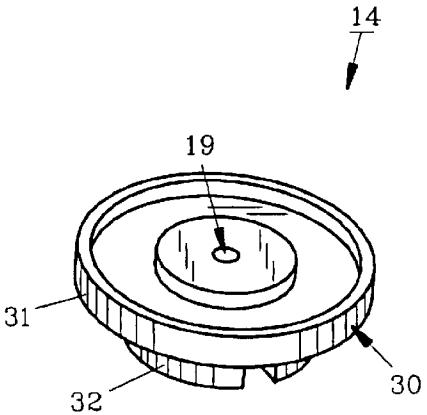
FIG. 5 features a top perspective view of the resilient foot removed from the cover panel.
Figure 7:
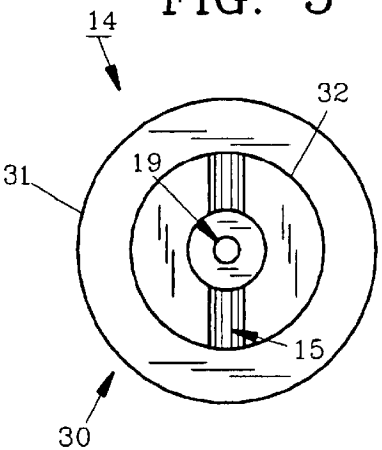
FIG. 7 shows a bottom plan view of the foot seen in FIG. 5.

As seen in FIGS. 3 and 4, cover 10 is in place on stove 20 with feet 14 straddling grate 21. Specifically, grate 21 includes a series of parallel lateral members 23 (FIG. 1) which are engaged by channel 15 (see FIGS. 6, 7 and 9) in feet 14, shown in more detail in FIG. 4. In FIG. 9, foot 14 is seen with substantially deep channel 15 in bottom conical portion 32 which allows lateral grate member 23 to be fully engaged. FIGS. 5–9 show various views of foot 14 in respectively, a top perspective, bottom perspective, bottom plan and side elevational views.

Preferred foot 14 as shown in FIGS. 5–9 is manufactured from a conventional black rubber having a 50–60 durometer (shore A) reading and having a height of 0.265" (0.67 cm) and an overall width of 2.102" (5.33 cm). Other materials which are suitably resilient or elastomeric may also be used. Channel 15 is preferably 0.317" (0.80 cm) wide with a radius of 0.13" (0.33 cm) to fit conventional grates. To provide convenience in placing foot 14 on a conventional grate, bottom conical portion 32 of foot 14 is slightly,tapered which decreases from a larger width at its top to a smaller width at the bottom to assist in placing it between lateral grate members 23 as shown in FIG. 1. Foot 14 as shown in FIGS. 5–9 includes body 30 having a thin disk-like top portion 31 integrally formed such as by molding with slightly tapered, thicker bottom conical portion 32.

In order to provide convenience to the customer and to increase the utility of stove cover 10, a plurality of apertures 17 are placed in the bottom surface of panel 11 (FIG. 1). Apertures 17 do not extend completely through panel 11 but extends preferably approximately one-half to three quarters the depth of panel 11. Aperture 17 allows for selective placement of feet 14 for different stove models, manufacturers and grate configurations. Such manufacturers may be Magic Chef, Suburban or Wedgewood to name a few.

In order to correctly attach feet 14 for a particular stove model, fasteners 18 (FIG. 6) are provided which pass through central opening 19 in foot 14 as shown in FIGS.

5–7. Central opening 19 intersects with channel 15 in bottom conical portion 32. As would be understood, fastener 18 comprises a conventional threaded wood screw of a length so as not to penetrate the top surface of panel 11 when foot 14 is tightened in place. By selectively placing feet 14 on mat 12 at desired locations to coincide with pre-drilled apertures 17 in panel 11, feet 14 can thereby be positioned to accommodate a wide variety of different grates such as grate 21 for various stoves.

In the method of use, the customer will receive cover 10 including panel 11 with standard resilient mat 12 affixed to the bottom surface thereof. Feet 14 are unattached upon delivery. As mentioned, under mat 12 in panel 11 are a plurality of apertures 17 to accommodate various stove grate configurations. A paper template (not shown) is also provided which has been designed and marked for easy location of pre-drilled apertures 17 for foot placement for the various model stoves. For example, once four apertures 17 are selected by the customer for a particular stove (and grate), as by placing the template on mat 12 after inverting panel 11 on a flat surface such as a table top, threaded fasteners 18 are then inserted in central openings 19 of feet 14 and a screwdriver is used to thread fastener 18 into the selected, pre-drilled apertures 17. Next, cover 10 is inverted and placed on the particular stove with feet 14 engaging the grate to provide an attractive, secure, noise-free cover which can be used as a counter space.

Should the stove not have a grate, feet 14 will not be attached and cover 10 will rest on resilient mat 12 against the stove surface to provide a noise-free, but less secure counter top.

The illustrations and examples provided herein are for explanatory purposes and are not intended to limit the scope of the appended claims.

What is claimed is:

1. A cover for a stove having a grate comprising: a panel, a resilient foot, said foot attached to the bottom of said panel, said foot defining a central opening and a channel for straddling said grate, said central opening intersecting said channel, a fastener, said fastener positioned in said central opening for affixing said foot to said panel.

2. The cover of claim 1 further comprising a resilient mat, said mat affixed to said panel bottom.

3. The cover of claim 1 wherein said panel defines a plurality of apertures for selectively receiving said threaded fastener.

4. The cover of claim 1 wherein said panel is formed of wood.

5. A cover for a RV stove having a grate comprising: a rigid panel, a resilient mat, said mat affixed to the bottom of said panel, said panel defining a plurality of apertures, a plurality of resilient feet, said feet each defining a central opening, a plurality of fasteners, one each of said fasteners positioned in one of said central openings, each of said fasteners positioned in selected ones of said panel apertures to maintain said feet on said panel, each of said plurality of said feet defining a channel, said channel intersecting said central opening, and each of said channels for straddling said grate to securely maintain said panel on said stove.

6. The cover of claim 5 wherein said fasteners are threaded.

7. The cover of claim 5 wherein said plurality of feet comprises four feet.

8. A foot for a stove top cover used with a stove having lateral grate members comprising: a body, said body defining a central opening, said central opening for receiving a fastener, said body defining a channel, said channel positioned perpendicular to and intersecting with said central opening said channel for straddling a lateral grate member to hold the stove top cover in a secure manner thereon.

9. The foot of claim 8 formed of a resilient material.

10. The foot of claim 8 formed of rubber.

11. The foot of claim 8 wherein said body comprises a like top and a conical portion, said top attached to said conical portion.

12. The foot of claim 8 formed from an elastomeric material.

* * * * *